US005984168A

United States Patent [19]

Clark

[11] Patent Number: 5,984,168

[45] Date of Patent: Nov. 16, 1999

[54] ONE PIECE TRIO OF DIAMOND SHAPED CARTONS

[75] Inventor: Mitchell Clark, Great Neck Long Island, N.Y.

[73] Assignee: International Paper Company, Purchase, N.Y.

[21] Appl. No.: 09/082,895

[22] Filed: May 21, 1998

[51] Int. Cl.[6] ..... B65D 23/00

[52] U.S. Cl. ..... 229/120.01; 229/108; 229/120.011

[58] Field of Search ..... 229/108, 120.01, 229/120.08, 120.18, 120.011, 120.012, 116.1; D9/430, 433, 346

[56] References Cited

U.S. PATENT DOCUMENTS 1,322,637 11/1919 Smith ..... 229/108
1,504,222 8/1924 Dyer ..... 229/108
1,998,147 4/1935 Stegman ..... 229/120.012
3,610,514 10/1971 Samsing ..... 229/108
3,785,545 1/1974 Roussel ..... 229/120.011
4,382,344 5/1983 Freeman ..... 229/120.01

*Primary Examiner*—Gary E. Elkins
*Attorney, Agent, or Firm*—Richard R. Muccino

[57] ABSTRACT

The present invention is directed to a one piece blank of foldable sheet material cut and scored so that it is divided into a series of connected wall forming panels which when assembled provides a trio of diamond shaped cartons for packaging articles, each carton connected to another carton by a common edge. The present invention is also directed to a one piece trio of diamond shaped cartons for packaging articles, each carton connected to another carton by a common edge.

4 Claims, 5 Drawing Sheets

FRONT AND TOP VIEW SETUP

ONE PIECE TRIO OF DIAMOND SHAPED CARTONS

FIELD OF THE INVENTION

The present invention is directed to a one piece blank of foldable sheet material cut and scored so that it is divided into a series of connected wall forming panels which when assembled provides a trio of diamond shaped cartons for packaging articles, each carton connected to another carton by a common edge. The present invention is also directed to a one piece trio of diamond shaped cartons for packaging articles, each carton connected to another carton by a common edge.

DESCRIPTION OF THE BACKGROUND

Many types of cartons for packaging articles are known. However, these cartons have not been suitable for use when several cartons are desired, such as those where each carton is attached to another carton, particularly diamond shaped cartons. The preparation of such an arrangement generally requires the use of several different blanks that must be glued together to form the final carton.

U.S. Pat. No. 1,998,147 (F. C. Stegman) discloses a bottle carton consisting of a longitudinal series of vertical hexagonal individual bottle receiving cells with a shock absorbing support at the bottom of the cells to prevent damage to the bottles. Each cell is a complete structural unit even when separated from the other cells. The bottle carton comprises a combination of a pair of duplicate blanks cut, scored, connected and set up to provide a longitudinal series of vertical hexagonal individual bottle-receiving cells. The blanks have vertical weakened lines between the cells facilitating their separation, and leaving when separated vertical laterally-projecting flanges at opposite angles of the cells. The lower portions of the blanks are cut and scored to provide semi-hexgonal half bottom panels folded inwardly from opposite side walls of the cells in vertically spaced relation to the lower ends of the other side walls. The edges of the walls adjacent the panels are bevelled to prevent binding of the panels as they are folded inwardly. The bottom panels have at their inner edges downturned bottom flanges extending between the vertical flanges and providing with the lower ends of the other walls, a shock absorbing support for the bottom of the cell which is in an elevated position. A means is provided for connecting the vertical and bottom flanges of the cells so that each cell is a complete structural unit even when separated from the other cells of the series. F. C. Stegman does not teach a trio carton wherein each carton is attached by a common edge or axis to another carton because the blanks of F. C. Stegman have vertical weakened lines between the cells facilitating their separation and when separated leave vertical laterally-projecting flanges at opposite angles of the cells.

U.S. Pat. No. 2,342,623 (S. A. Aquino) discloses a one piece multicompartment container provided with a central partition. The container comprises at least six relatively flat side members fastened together in polygonal shape, wherein the top members and bottom members cooperate with the side members. A partition is provided dividing the column enclosed by the side members into two compartments, each defined by an odd number of the side members and one of the top and bottom members. The partition comprises two separate panel elements, arranged back to back. Each panel has a height of about the height of the side walls and extends between opposite sides formed by the side members. An edge portion of the cover member and an edge portion of the bottom member of each compartment is attached to the top and bottom edges respectively of the panel elements of the partition which forms a wall of the respective compartment. The bottom member of each compartment is attached at its opposite edge to one of the side members at the lower edge portion, whereby the bottom of each compartment is supported both by the partition and by one of the side members.

U.S. Pat. No. 3,004,696 (R. W. McCormick) discloses a polygonal compartmented container formed with partitions to provide a plurality of compartments, and having a bottom construction which includes a plurality of prismatic portions enabling the container to be positioned on uneven ground or to be interlocked with the prismatic portions of a similar container. The polygonal compartmented container is formed from foldable paperboard and comprises a plurality of elongated panels arranged in tubular form and hingedly connected in series at their longitudinal edges along parallel lines. A fold line extends at right angles, centrally across the panels, to divide the assembled panel group into two half sections. Two sets of fold lines each extend at acute angles to the central fold line and form a plurality of adjoined, endwise aligned, diamond shaped areas, located symmetrically along the central fold line with their transverse axes coinciding with alternate hinge lines of the panel group and with their apexes located at the intersections of the central fold line with the remaining alternate hinge lines of the panel group. One of the half sections of the assembled panels comprises inner partitions and is folded over along the central fold line and enclosed inside the other half section comprising the container outer walls. The outer walls and the enclosed inner partitions are collapsible to flat tubular form. The diamond shaped areas when the tubular construction is in expanded form, is collapsible inwardly and axially of the expanded tube, whereby to cause the pairs of partition panels adjoined to the inner sides of the respective diamond shaped areas to expand inwardly of the tube and form with the side wall panels on the other side of the respective diamond shaped areas similar compartments, each having a symmetrical diamond shape in cross-section.

U.S. Pat. No. 3,403,835 (J. M. Schwaner) discloses a multi-cell container assembly formed of separate unitary cells which have certain panels of each cell secured in face-to-face relationship permitting the container to be folded into a flat contour. The multi-cell container assembly comprises a plurality of polygonal container subassemblies each joined to each of its adjacent subassemblies at a single side panel to form one or more L-shaped, attached series of subassemblies. Further panels of the subassemblies within the bight of the L-shaped series are positioned in abutting relation to form a multi-cell container assembly in which at least two panels of each polygonal subassembly is reinforced by an adjacent subassembly panel.

U.S. Pat. No. 4,062,487 (Bliss) discloses a carton blank for a four-sided carton having a recessed double thickness handle formed as a part of the top closure. The carton blank comprises four rectangular side wall panels of equal size positioned in lateral alignment and connected by vertical fold lines. The side panels are defined along their top and bottom edges by horizontal fold lines. Bottom closure flaps are connected along the bottom edge of the side wall panels. A top closure for the blank is connected along the top edge of the blank including a first triangular handle section. The triangular section is formed as an isosceles triangle having a base equal to the width of a first adjacent pair of the side wall panels and having a center fold line extending vertically from the apex of the triangle to the point of intersection of the top edge fold line and the vertical hinge line connecting the first pair of adjacent side wall panels. The first triangular handle section has a slot cut on each side of the vertical fold line and is positioned along the diagonally positioned fold lines. A pair of fold lines extends diagonally from the point of intersection of the top edge hinge line and the hinge line connecting the first pair of adjacent side wall panels and intersecting the outer edges of the first triangular handle section. A second triangular handle section substantially similar in size and configuration to the first triangular handle section is connected along the top edge of the remaining two adjacent side wall panels. A pair of insertable tabs is formed as a part of and extends vertically from the second triangular handle section adjacent the apex of the second section. The tabs are formed in width substantially equal to or slightly less than the length of the slots. Die cut apertures are formed in that portion of each of the triangular handle sections on either side of each vertical fold line and above each of the diagonally positioned fold lines.

U.S. Pat. No. 4,601,390 (Rosenthal et al.) discloses a repeatably usable collapsible hand carrier for bottles of standard size. The carrier is fabricated of flexible panel material and has a structure comprising: A. front and rear side panels provided with complementary handle extensions; B. left and right end panels hingedly joined to the end edges of the side panels; C. a bottom panel hingedly joined to the bottom edges of the side panels and disconnected from the end panels, the bottom panel and the end panels all having a center fold to create a gusset whereby the carrier may be collapsed after use into a flat state by pressing the side panels together, and in doing so, causing the bottom panel and the end panel gussets to fold out, and the carrier may be erected for reuse by pulling the side panels apart; and D. four snap-in corner sections formed at the junctions of the side and end panels. Each section is defined by a pair of parallel slots spaced from the top and bottom edges of the panels and extends horizontally from the center fold of the related end panel and a vertical fold line on the related side panel. When the hand carrier is erected and a corner section is pressed in at its junction, the section then reverses itself to set up within the interior of the carrier a corner cell adapted to accommodate a single standard bottle.

U.S. Pat. No. 4,856,706 (VanDerStraten) discloses a packing device comprising a continuous row or at least one element in a flat extended position. Each element is composed of a bottom, a top panel, at least one end wall and side walls. The elements are hingeably connected together substantially along longitudinal ribs formed between the bottoms to form the continuous row of elements. The packing device is made from one unitary blank and the row of elements can be rolled up from its flat extended position to a closed polygonal block having a casing. End faces are provided in which the interconnected bottoms and the side walls of the elements are combined to form the casing and the end faces, respectively, of the block.

U.S. Pat. No. 5,107,985 (Bezrutczyk) discloses a display carton for holding and displaying an article including a tubular container structure and a tubular drawer structure by which an article is displayed by opening and closing the drawer. The carton is made from a unitary blank of foldable sheet material, such as paper board, and comprises a plurality of container panels foldably interconnected along primary fold lines to form a tubular container structure open at its ends. Container end closure flaps are provided foldably joined to the container panels and secured in overlapped relation to close the ends of the tubular container structure. An opening is provided in at least one of the container panels defining an opening to the interior of the container structure; a plurality of drawer panels are provided foldably interconnected along secondary fold lines to form a tubular drawer structure open at its ends, one of the drawer panels being joined to one of the container panels along a hinge line; drawer end closure flaps are provided joined to the drawer panels and secured in overlapped relation to close the ends of the tubular drawer structure. The drawer structure is hingedly connected to the container structure with respect to the hinge line for movement through the opening between a first closed position situated within the interior of the container structure and a second open position situated at least in part outside of the container structure.

U.S. Pat. No. 5,601,231 (Cai) discloses a multi-partitioned meal tray or container for holding food products. The container is made from a unitary blank and comprises a planar base and a plurality of straight, equal length sidewalls having respective bottom edges integrally joined to the planar base. Each of the sidewalls has opposed ends joined at an obtuse angle to corresponding ends of adjacent sidewalls to define corners. The plurality of sidewalls and the corners define a periphery of the container. The container further comprises a plurality of integral internal partitions extending along the planar base. Each of the internal partitions has first and second ends. At least two of the internal partitions each have its first end joined to a respective one of the corners. At least two of the internal partitions have their second ends joined together. A further one of the internal partitions has a first end joined to the periphery of the container and a second end joined to the second ends of the at least two of the internal partitions.

IN THE FIGURES

SUMMARY OF THE INVENTION

Figure 1:
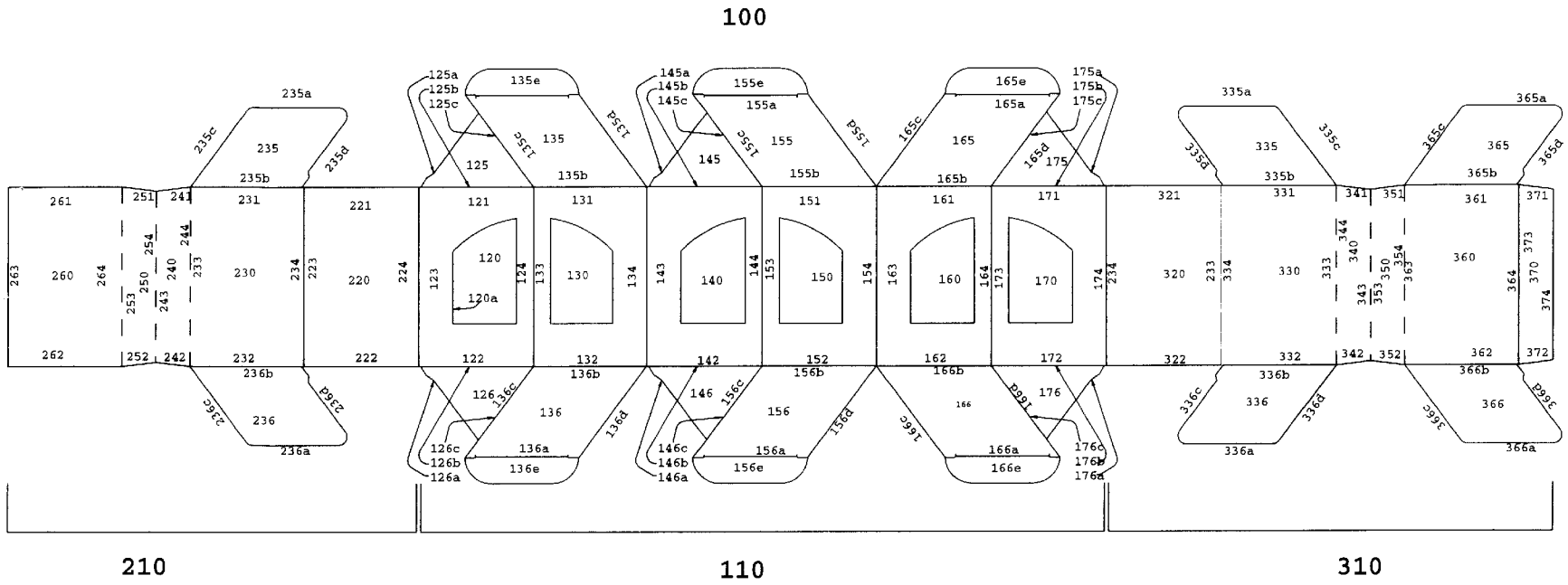
FIG. 1 shows a flat view of one piece stock, unassembled, from which the diamond shape trio carton may be made constructed in accordance with a preferred embodiment of the present invention.

The present invention is directed to a one piece blank of foldable sheet material cut and scored so that it is divided into a series of connected wall forming panels which when assembled provides a trio of diamond shaped cartons for packaging articles wherein the blank comprises:

(A) a first carton forming section having:

(a) first, second, third, fourth, fifth, and sixth rectangular wall panels of substantially equal size positioned in lateral alignment and connected by vertical fold lines, each wall panel having a top, a bottom, and two sides;

(b) top and bottom closing flaps foldably connected to the top and bottom of each rectangular wall panel, respectively, for closing the carton; wherein the top and bottom closing flaps on the first, third, and sixth wall panels are in the shape of an isosceles triangle having a bottom and two equal sides, the bottom of the isosceles triangle being connected to the respective wall panel; and the top and bottom closing flaps on the second, fourth, and fifth wall panels are in the shape of a parallelogram having a parallel top and bottom and two parallel sides, the bottom of the parallelogram closing flaps being connected to the respective wall panel; the sides of the parallelogram closing flaps on the second, fourth, and fifth wall panels being parallel to the adjacent side of the isosceles triangle closing flaps on the first, third, and sixth wall panel, respectively; each parallelogram closing flap having an interlocking flap hingedly connected to the top and defined by a horizontal fold line;

(B) a second carton forming section having:

(a) seventh, eighth, ninth, tenth, and eleventh rectangular wall panels in lateral alignment and connected by vertical fold lines, each wall panel having a top, a bottom, and two sides; the seventh, eighth, and eleventh rectangular wall panels being substantially similar in size to the rectangular wall panels in the first carton forming section, and the ninth and tenth rectangular wall panels being reverse score glue panels having a narrower top and bottom than the top and bottom of the seventh, eighth, and eleventh rectangular wall panels;

(b) a top and a bottom closing flap foldably connected to the top and bottom of the eighth wall panel, respectively, for closing the carton, wherein the top and bottom closing flaps are in the shape of a parallelogram having a parallel top and bottom and two parallel sides, the bottom of the parallelogram closing flap being connected to the respective wall panel, the sides of the parallelogram top and bottom closing flaps on the eighth wall panel being parallel to the sides of the parallelogram top and bottom closing flaps on the fifth wall panel in the first carton forming section, respectively; and (C) a third carton forming section having:

(a) twelfth, thirteenth, fourteenth, fifteenth, sixteenth, and seventeenth rectangular wall panels in lateral alignment and connected by vertical fold lines, each wall panel having a top, a bottom, and two sides; the twelfth, thirteenth, and sixteenth rectangular wall panels being substantially similar in size to the wall panels in the first carton forming section; the fourteenth and fifteenth rectangular wall panels being reverse score glue panels; and the seventeenth rectangular wall panel being a glue panel; each glue panel having a narrower top and bottom than the top and bottom of the twelfth, thirteenth, and sixteenth rectangular wall panels;

(b) top and bottom closing flaps foldably connected to the top and bottom of the thirteenth and sixteenth wall panels, respectively, for closing the carton; wherein the top and bottom closing flaps on the thirteenth and sixteenth wall panels are in the shape of a parallelogram having a parallel top and bottom and two parallel sides, the bottom of the parallelogram closing flaps being connected to the wall panel; the sides of the parallelogram top and bottom closing flaps on the thirteenth wall panel being parallel to the sides of the parallelogram top and bottom closing flaps on the fourth wall panel in the first carton forming section, respectively; the sides of the parallelogram top and bottom closing flaps on the sixteenth wall panel being parallel to the sides of the parallelogram top and bottom closing flaps on the fifth wall panel in the first carton forming section, respectively;

wherein a side of the first rectangular wall panel in the first carton forming section is connected by a vertical fold line to a side of the seventh rectangular wall panel in the second carton forming section; and a side of the sixth rectangular wall panel in the first carton forming section is connected by a vertical fold line to a side of the twelfth rectangular wall panel in the third carton forming section.

In another embodiment, the invention is directed to a one piece trio of diamond shaped cartons for packaging articles comprising:

(A) a first diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other via a glue panel along a common side;

(c) a diamond shaped bottom panel for closing the bottom of the carton; and (d) a diamond shaped top panel for closing the top of the carton;

wherein the first rectangular front wall panel is connected to the first rectangular back wall panel along a common side, and the second rectangular front wall panel is connected to the second rectangular back wall panel along a common side;

(B) a second diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other along a common side;

(c) a diamond shaped bottom panel for closing the bottom of the carton; and (d) a diamond shaped top panel for closing the top of the carton;

wherein the first rectangular front wall panel is connected to the first rectangular back wall panel along a common side, and the second rectangular front wall panel is connected to the second rectangular back wall panel via a reverse score glue panel along a common side; and (C) a third diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other along a common side;

(c) a diamond shaped bottom panel for closing the bottom of the carton; and (d) a diamond shaped top panel for closing the top of the carton;

wherein the first rectangular front wall panel is connected to the first rectangular back wall panel via a reverse score glue panel along a common side, and the second rectangular front wall panel is connected to the second rectangular back wall panel along a common side;

wherein the second rectangular front wall panel and second rectangular back wall panel in the second diamond shaped carton section are connected to the first rectangular front wall panel and first rectangular back wall panel in the first diamond shaped carton section via a reverse score glue panel along a common side, and the first rectangular front wall panel and first rectangular back wall panel in the third diamond shaped carton section are connected to the second rectangular front wall panel and second rectangular back wall panel in the first diamond shaped carton section via a reverse score glue panel along a common side, to form a one piece trio of diamond shaped cartons for packaging articles.

DETAILED DESCRIPTION OF THE INVENTION

Figure 2:
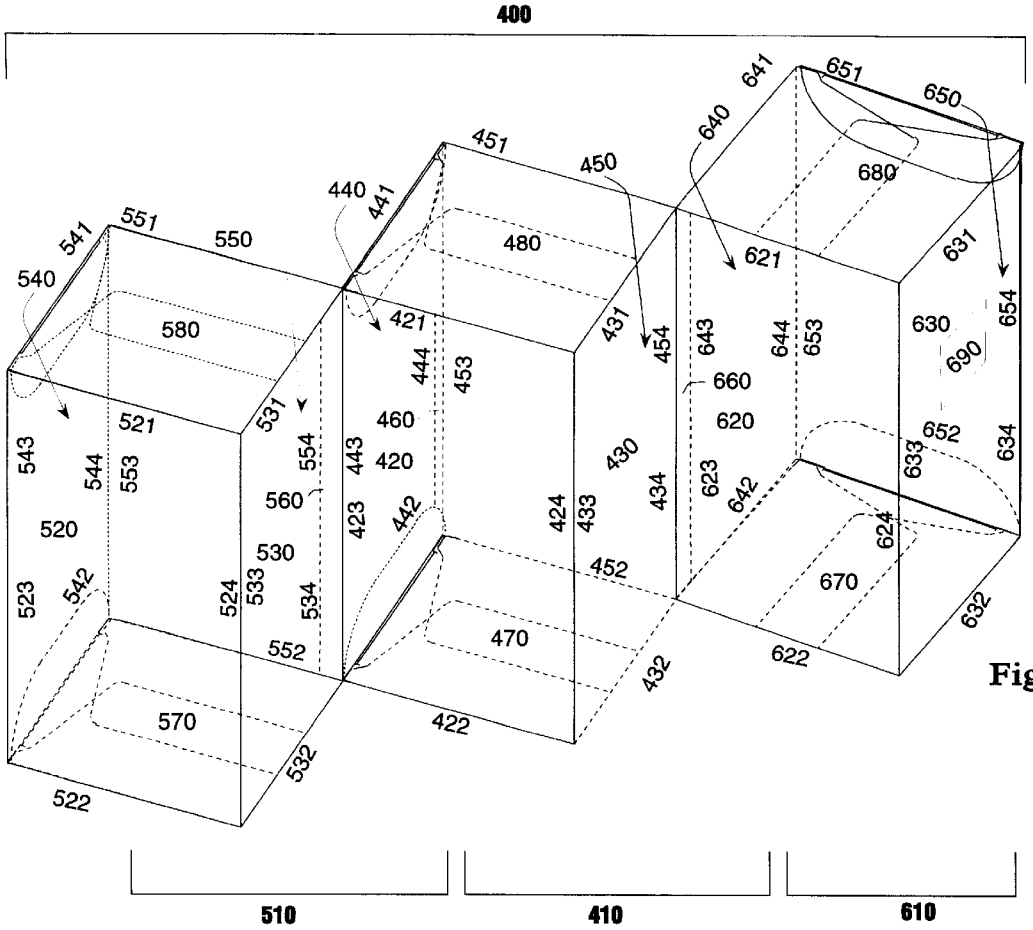
FIG. 2 shows a front and top view of the diamond shape trio carton in assembled and open form constructed in accordance with a preferred embodiment of the present invention.
Figure 3:
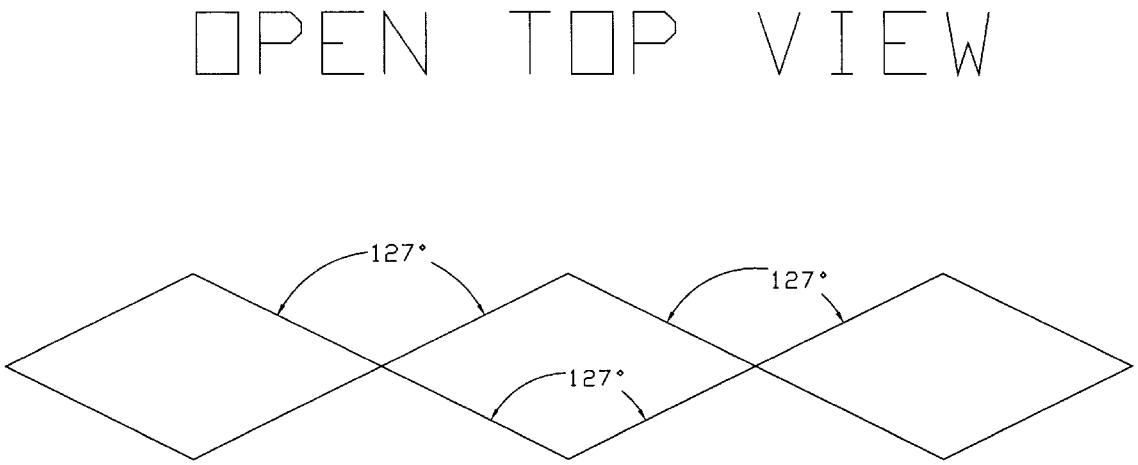
FIG. 3 shows a top view of the diamond shape trio carton in assembled and open form constructed in accordance with a preferred embodiment of the present invention.
Figure 4:
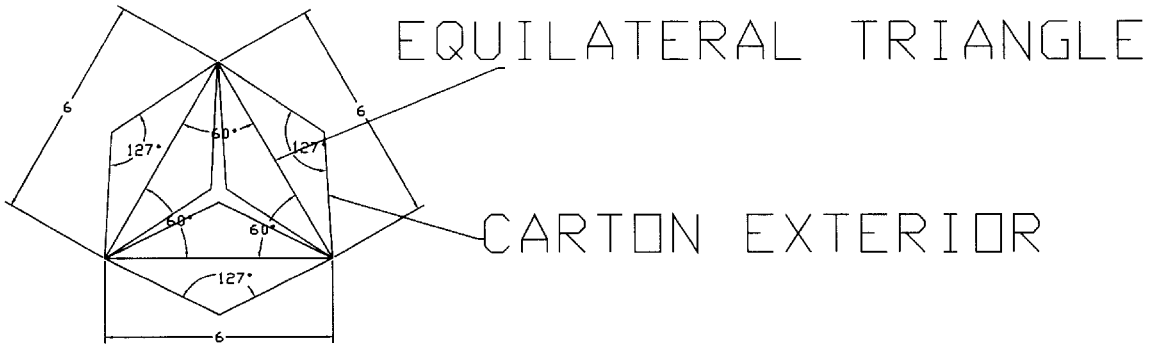
FIG. 4 shows a top view of the diamond shape trio carton in assembled and closed form, to form a hexagonal shape constructed in accordance with a preferred embodiment of the present invention.

The invention is directed to a trio of diamond shaped cartons, or three diamond shaped cartons, the first attached to the second, and the second attached to the third, each carton attached by a common edge or axis to another carton. FIG. 1 shows a flat view of one piece stock, unassembled, from which the trio carton may be made. FIG. 2 shows a front and top view of the trio carton in assembled and open form, each carton is in a diamond shape. FIG. 3 shows a top view of the trio carton in assembled and open form, each carton is in a diamond shape. FIG. 4 shows a top view of the trio carton in assembled and closed form, in a hexagonal shape. The axes of the three diamond shaped cartons in open form, shown in FIGS. 2–3, may be folded to form a hexagonal shape carton in closed form, shown in FIG. 4, and unfolded to reform the three diamond shaped cartons shown in FIGS. 2–3. The advantage of the novel trio carton over conventional cartons is that it can be made from one piece of stock. The trio carton is useful as a novelty package for various consumer products.

The invention will be better understood from the following detailed description of the preferred embodiments taken in conjunction with the Figures, in which like elements are represented by like referenced numerals.

In FIG. 1, a one piece blank of foldable sheet material is depicted generally as 100 and constructed in accordance with a preferred embodiment of the present invention. Blank 100 is cut and scored so that it is divided into a series of connected wall forming panels which when assembled provides a one piece trio of diamond shaped cartons for packaging articles, each carton connected to another carton by a common edge.

Blank 100 comprises a first carton forming section 110 having first 120, second 130, third 140, fourth 150, fifth 160, and sixth 170 rectangular wall panels of substantially equal size positioned in lateral alignment and connected by vertical fold lines. Each wall panel has a top (121, 131, 141, 151, 161, 171), a bottom (122, 132, 142, 152, 162, 172), and two sides, a left side (123, 133, 143, 153, 163, 173) and a right side (124, 134, 144, 154, 164, 174). Top closing flaps (125, 135, 145, 155, 165, 175) and bottom closing flaps (126, 136, 146, 156, 166, 176) foldably connect to the top (121, 131, 141, 151, 161, 171) and bottom (122, 132, 142, 152, 162, 172) of each wall rectangular panel, respectively, for closing the carton. The top closing flaps (125, 145, 175) and bottom closing flaps (126, 146, 176) on the first, third, and sixth wall panels (120, 140, 170) are in the shape of an isosceles triangle having a bottom (125*b*, 145*b*, 175*b*, 126*b*, 146*b*, 176*b*) and two equal sides (125*a*, 125*c*, 145*a*, 145*c*, 175*a*, 175*c*, 126*a*, 126*c*, 146*a*, 146*c*, 176*a*, 176*c*). The bottoms of the isosceles triangle (125*b*, 145*b*, 175*b*, 126*b*, 146*b*, 176*b*) are connected to the rectangular wall panels, (120, 140, 170), respectively. The top closing flaps (135, 155, 165) and bottom closing flaps (136, 156, 166) on the second, fourth, and fifth wall panels (130, 150, 160), respectively, are in the shape of a parallelogram having a parallel top (135*a*, 155*a*, 165*a*, 136*a*, 156*a*, 166*a*) and bottom (135*b*, 155*b*, 165*b*, 136*b*, 156*b*, 166*b*) and two parallel sides (135*c*, 135*d*, 155*c*, 155*d*, 165*c*, 165*d*, 136*c*, 136*d*, 156*c*, 156*d*, 166*c*, 166*d*). The bottoms of the parallelogram closing flaps (135*b*, 155*b*, 165*b*, 136*b*, 156*b*, 166*b*) are connected to the rectangular wall panel (130, 150, 160), respectively. The sides of the parallelogram closing flaps (135*c*, 135*d*, 155*c*, 155*d*, 165*c*, 165*d*, 136*c*, 136*d*, 156*c*, 156*d*, 166*c*, 166*d*) on the second, fourth, and fifth wall panel (130, 150, 160) are parallel to the adjacent side of the isosceles triangle closing flaps (125*c*, 145*c*, 165*c*, 126*c*, 146*c*, 176*c*) on the first, third, and sixth wall panel (120, 140, 170), respectively. Each parallelogram closing flap (135, 155, 165, 136, 156, 166) has an interlocking flap (135*e*, 155*e*, 165*e*, 136*e*, 156*e*, 166*e*), respectively, hingedly connected to the top and defined by a horizontal fold line at (135*a*, 155*a*, 165*a*, 136*a*, 156*a*, 166*a*), respectively.

Blank 100 also comprises a second carton forming section 210 having seventh 220, eighth 230, ninth 240, tenth 250, and eleventh 260 rectangular wall panels in lateral alignment and connected by vertical fold lines. Each wall panel has a top (221, 231, 241, 251, 261), a bottom (222, 232, 242, 252, 262), and two sides (223, 224, 233, 234, 243, 244, 253, 254, 263, 264). The seventh 220, eighth 230, and eleventh 260 rectangular wall panels are substantially similar in size and configuration to the rectangular wall panels in the first carton forming section 110. The ninth 240 and tenth 250 rectangular wall panels are reverse score glue panels having a narrower top and bottom than the top and bottom of the seventh 220, eighth 230, and eleventh 260 rectangular wall panels, which ultimately is glued to rectangular wall panel 130 along common side 134. A reverse score glue panel comprises two panels, a first panel 250 for gluing to the blank and a second panel 240 for folding or reversing over the first panel. A top 235 and a bottom 236 closing flap are foldably connected to the top 231 and bottom 232 of the eighth wall panel 230, respectively, for closing the carton. The top 231 and bottom 232 closing flaps are in the shape of a parallelogram having a parallel top (235*a*, 236*a*) and bottom (235*b*, 236*b*) and two parallel sides (235*c*, 235*d*, 236*c*, 236*d*). The bottom of the parallelogram closing flaps (235*b*, 236*b*) are connected to the wall panel 230. The sides of the parallelogram top (235*c*, 235*d*) and bottom (236*c*, 236*d*) closing flaps on the eighth wall panel 230 are parallel to the sides of the parallelogram top (165*c*, 165*d*) and bottom (166*c*, 166*d*) closing flaps on the fifth wall panel 160 in the first carton forming section, respectively.

Blank 100 also comprises a third carton forming section 310 having twelfth 320, thirteenth 330, fourteenth 340, fifteenth 350, sixteenth 360, and seventeenth 370 rectangular wall panels in lateral alignment and connected by vertical fold lines. Each wall panel has a top (321, 331, 341, 351, 361, 371), a bottom (322, 332, 342, 352, 362, 372), and two sides (323, 324, 333, 334, 343, 344, 353, 354, 363, 364, 373, 374). The twelfth 320, thirteenth 330, and sixteenth 340 rectangular wall panels are substantially similar in size and configuration to the wall panels in the first carton forming section 110. The fourteenth 340 and fifteenth 350 rectangular wall panels are reverse score glue panels, which ultimately is glued to rectangular wall panel 160 along common side 164. A reverse score glue panel comprises two panels, a first panel 350 for gluing to the blank and a second panel 340 for folding or reversing over the first panel. The seventeenth 370 rectangular wall panel is a glue panel, which ultimately is glued to rectangular wall panel 260 along common side 263. Each glue panel has a narrower top and bottom than the top and bottom of the twelfth 320, thirteenth 330, and sixteenth 360 rectangular wall panels. Top (335, 365) and bottom (336, 366) closing flaps are foldably connected to the top (331, 361) and bottom (332, 362), respectively, of the thirteenth 330 and sixteenth 360 rectangular wall panels for closing the carton. The top (335, 365) and bottom (336, 366) closing flaps on the thirteenth 330 and sixteenth 360 wall panels are in the shape of a parallelogram having a parallel top (335*a*, 365*a*, 336*a*, 366*a*) and bottom (335*b*, 365*b*, 336*b*, 366*b*) and two parallel sides (335*c*, 335*d*, 365*c*, 365*d*, 336*c*, 336*d*, 366*c*, 366*d*). The bottom of the parallelogram closing flap(335*b*, 365*b*, 336*b*, 366*b*) is connected to the respective wall panel (330, 360). The sides of the parallelogram top (335*c*, 335*d*) and bottom closing flaps (336*c*, 336*d*) on the thirteenth 330 wall panel are parallel to the sides of the parallelogram top (155*c*, 155*d*) and bottom (156*c*, 156*d*) closing flaps on the fourth wall panel 150, respectively. The sides of the parallelogram top (365*c*, 365*d*) and bottom (366*c*, 366*d*) closing flaps on the sixteenth 360 wall panel are parallel to the sides of the parallelogram top (165*c*, 165*d*) and bottom (166*c*, 166*d*) closing flaps on the fifth wall panel 160, respectively.

A side of the first rectangular wall panel 123 in the first carton forming section 110 is in lateral alignment and connected by a vertical fold line to a side of the seventh rectangular wall panel 224 in the second carton forming section 210. A side of the sixth rectangular wall panel 174 in the first carton forming section 110 is in lateral alignment and connected by a vertical fold line to a side of the twelfth rectangular wall panel 323 in the third carton forming section 310.

Optionally, at least one rectangular wall panel contains a cut out 120*a* for a window.

In FIG. 2, a one piece trio of diamond shaped cartons for packaging articles, each carton connected to another carton by a common edge, is depicted generally as 400 and constructed in accordance with a preferred embodiment of the present invention.

The one piece trio of diamond shaped cartons 400 comprises a first diamond shaped carton section 410 having first 420 and second 430 rectangular front wall panels having a top (421, 431), a bottom (422, 432), and two sides (423, 424, 433, 434), the panels connected to each other along a common side (424, 433). First 440 and second 450 rectangular back wall panels have a top (441, 451), a bottom (442, 452), and two sides (443, 444, 453, 454). The panels (440, 450) are connected to each other via a glue panel 460 along a common side (444, 453). Glue panel 460 is also shown in FIG. 1 as glue panel 370. A diamond shaped bottom panel 470 closes the bottom of the carton and a diamond shaped top panel 480 closes the top of the carton. The diamond shaped top panels 480 are also shown in FIG. 1 as diamond shaped top panels 155, 145, and 365. The diamond shaped bottom panels 470 are shown in FIG. 1 as 156, 146, and 366. The first rectangular front wall panel 420 is connected to the first rectangular back wall panel 440 along a common side (423, 443), and the second rectangular front wall panel 430 is connected to the second rectangular back wall panel 450 along a common side (434, 454).

The one piece trio of diamond shaped cartons 400 also comprises a second diamond shaped carton section 510 having first 520 and second 530 rectangular front wall panels having a top (521, 531), a bottom (522, 532), and two sides (523, 524, 533, 534). The panels (510, 520) are connected to each other along a common side (524, 533). First 540 and second 550 rectangular back wall panels have a top (541, 551), a bottom (542, 552), and two sides (543, 544, 553, 554). The panels are connected to each other along a common side (544, 553). A diamond shaped bottom panel 570 closes the bottom of the carton and a diamond shaped top panel 580 closes the top of the carton. The diamond shaped top panels are also shown in FIG. 1 as diamond shaped top panels 135, 125, and 235. The diamond shaped bottom panels are shown in FIG. 1 as 136, 126, and 236. The first rectangular front wall panel 520 is connected to the first rectangular back wall panel 540 along a common side (523, 543), and the second rectangular front wall panel 530 is connected to the second rectangular back wall panel 550 via a reverse score glue panel 560 along a common side (534, 554). Reverse score glue panel 560 is also shown in FIG. 1 as reverse score glue panel 240, 250.

The one piece trio of diamond shaped cartons 400 also comprises a third diamond shaped carton section 610 having first 620 and second 630 rectangular front wall panels having a top (621, 631), a bottom (622, 632), and two sides (623, 624, 633, 634). The panels are connected to each other along a common side (624, 633). First 640 and second 650 rectangular back wall panels have a top (641, 651), a bottom (642, 652), and two sides (643, 644, 653, 654). The panels (640, 650) are connected to each other along a common side (644, 653). A diamond shaped bottom panel 670 closes the bottom of the carton, and a diamond shaped top panel 680 closes the top of the carton. The diamond shaped top panel 680 is also shown in FIG. 1 as diamond shaped top panel 165, 175, and 335. The diamond shaped bottom panel 670 is also shown in FIG. 1 as diamond shaped top panel 166, 176, and 336. The first rectangular front wall panel 620 is connected to the first rectangular back wall panel 640 via a reverse score glue panel 660 along a common side (623, 643). Reverse score glue panel 660 is shown in FIG. 1 as reverse score glue panel 340, 350. The second rectangular front wall panel 630 is connected to the second rectangular back wall panel 650 along a common side (634, 654).

The second rectangular front wall panel 530 and second rectangular back wall panel 550 in the second diamond shaped carton section 510 are connected to the first rectangular front wall panel 420 and first rectangular back wall panel 440 in the first diamond shaped carton section 410 along a common side (534, 554, 423, 443) via reverse score glue panel 560. The first rectangular front wall panel 620 and first rectangular back wall panel 640 in the third diamond shaped carton section 610 are connected to the second rectangular front wall panel 430 and second rectangular back wall panel 450 in the first diamond shaped carton section 410 along a common side (434, 454, 623, 643) via reverse score glue panel 660 to form the one piece trio of diamond shaped cartons for packaging articles 400.

Optionally, at least one rectangular wall panel in the one piece trio of diamond shaped cartons may contain a cut out for a window 690.

Figure 5:
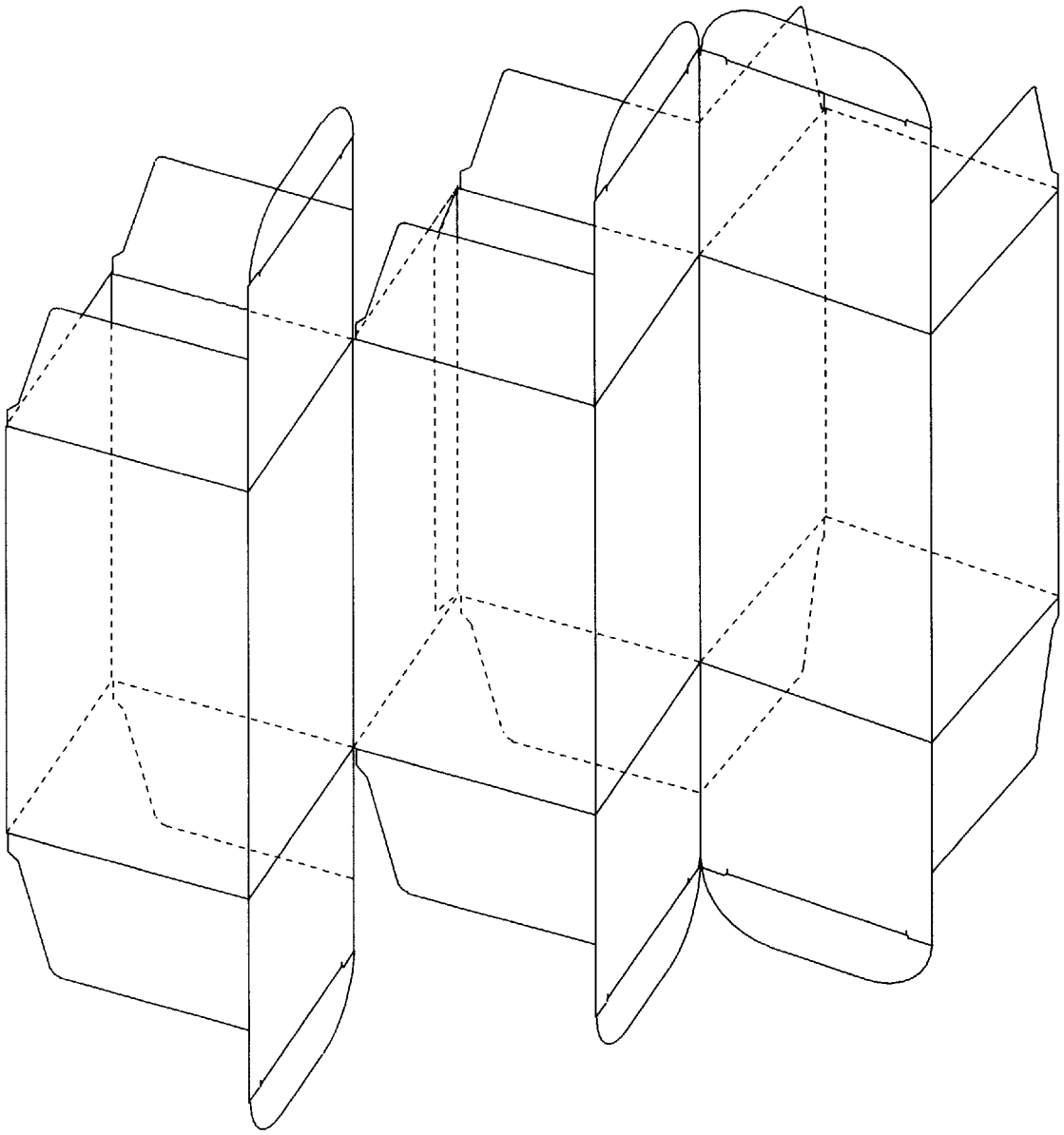
FIG. 5 shows another front and top view of the diamond shape trio carton in assembled and open form constructed in accordance with a preferred embodiment of the present invention.

FIG. 3 shows a top view of the diamond shape trio carton in assembled and open form constructed in accordance with a preferred embodiment of the present invention. FIG. 4 shows a top view of the diamond shape trio carton in assembled and closed form, to form a hexagonal shape constructed in accordance with a preferred embodiment of the present invention. FIG. 5 shows another front and top view of the diamond shape trio carton in assembled and open form constructed in accordance with a preferred embodiment of the present invention.

The one piece trio of diamond shaped cartons for packaging articles of the present invention provides cartons wherein each carton is connected to another carton by a common edge. The cartons can be used with automatic machinery equipment which will erect the carton in the machine and will automatically fill the carton with the article or articles to be packaged. The face of the one piece trio of diamond shaped cartons for packaging articles of the present invention are clean in their original, glued, sealed position.

The one piece trio of diamond shaped cartons can be used to accommodate a wide variety of articles or products in different container sizes. While the one piece trio of diamond shaped cartons for packaging articles has been shown in connection with certain preferred embodiments as shown, other embodiments of different shapes or locations can be utilized with varying container shapes. In addition, more or less score lines can be added as appropriate to make the one piece trio of diamond shaped cartons for packaging articles more flexible for machine insertion of the object to be packaged. In addition, multiple cutouts can be utilized where appropriate for either multiple objects to be held or due to the shape of the object to be held.

The invention being thus described, it will be obvious that the same may be varied in many ways. Such variations are not to be regarded as a departure from the spirit and scope of the invention and all such modifications are intended to be included within the scope of the following claims.

I claim:

1. A one piece blank of foldable sheet material cut and scored so that it is divided into a series of connected wall forming panels which when assembled provides a trio of diamond shaped cartons for packaging articles wherein the blank comprises:

(A) a first carton forming section having:

(a) first, second, third, fourth, fifth, and sixth rectangular wall panels of substantially equal size positioned in lateral alignment and connected by vertical fold lines, each wall panel having a top, a bottom, and two sides;

(b) top and bottom closing flaps foldably connected to the top and bottom of each rectangular wall panel, respectively, for closing the carton; wherein the top and bottom closing flaps on the first, third, and sixth wall panels are in the shape of an isosceles triangle having a bottom and two equal sides, the bottom of the isosceles triangle being connected to the respective wall panel; and the top and bottom closing flaps on the second, fourth, and fifth wall panels are in the shape of a parallelogram having a parallel top and bottom and two parallel sides, the bottom of the parallelogram closing flaps being connected to the respective wall panel; the sides of the parallelogram closing flaps on the second, fourth, and fifth wall panels being parallel to the adjacent side of the isosceles triangle closing flaps on the first, third, and sixth wall panel, respectively; each parallelogram closing flap having an interlocking flap hingedly connected to the top and defined by a horizontal fold line;

(B) a second carton forming section having:

(a) seventh, eighth, ninth, tenth, and eleventh rectangular wall panels in lateral alignment and connected by vertical fold lines, each wall panel having a top, a bottom, and two sides; the seventh, eighth, and eleventh rectangular wall panels being substantially similar in size to the rectangular wall panels in the first carton forming section, and the ninth and tenth rectangular wall panels being reverse score glue panels having a narrower top and bottom than the top and bottom of the seventh, eighth, and eleventh rectangular wall panels;

(b) a top and a bottom closing flap foldably connected to the top and bottom of the eighth wall panel, respectively, for closing the carton, wherein the top and bottom closing flaps are in the shape of a parallelogram having a parallel top and bottom and two parallel sides, the bottom of the parallelogram closing flap being connected to the respective wall panel, the sides of the parallelogram top and bottom closing flaps on the eighth wall panel being parallel to the sides of the parallelogram top and bottom closing flaps on the fifth wall panel in the first carton forming section, respectively; and (C) a third carton forming section having:

(a) twelfth, thirteenth, fourteenth, fifteenth, sixteenth, and seventeenth rectangular wall panels in lateral alignment and connected by vertical fold lines, each wall panel having a top, a bottom, and two sides; the twelfth, thirteenth, and sixteenth rectangular wall panels being substantially similar in size to the wall panels in the first carton forming section; the fourteenth and fifteenth rectangular wall panels being reverse score glue panels; and the seventeenth rectangular wall panel being a glue panel; each glue panel having a narrower top and bottom than the top and bottom of the twelfth, thirteenth, and sixteenth rectangular wall panels;

(b) top and bottom closing flaps foldably connected to the top and bottom of the thirteenth and sixteenth wall panels, respectively, for closing the carton; wherein the top and bottom closing flaps on the thirteenth and sixteenth wall panels are in the shape of a parallelogram having a parallel top and bottom and two parallel sides, the bottom of the parallelogram closing flaps being connected to the wall panel; the sides of the parallelogram top and bottom closing flaps on the thirteenth wall panel being parallel to the sides of the parallelogram top and bottom closing flaps on the fourth wall panel in the first carton forming section, respectively; the sides of the parallelogram top and bottom closing flaps on the sixteenth wall panel being parallel to the sides of the parallelogram top and bottom closing flaps on the fifth wall panel in the first carton forming section, respectively;

wherein a side of the first rectangular wall panel in the first carton forming section is connected by a vertical fold line to a side of the seventh rectangular wall panel in the second carton forming section; and a side of the sixth rectangular wall panel in the first carton forming section is connected by a vertical fold line to a side of the twelfth rectangular wall panel in the third carton forming section.

2. The one piece blank according to claim 1, wherein at least one rectangular wall panel contains a cut out for a window.

3. A one piece trio of diamond shaped cartons for packaging articles comprising:

(A) a first diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other via a glue panel along a common side;

(c) a diamond shaped bottom panel for closing the bottom of the carton; and (d) a diamond shaped top panel for closing the top of the carton; wherein the first rectangular front wall panel is connected to the first rectangular back wall panel along a common side, and the second rectangular front wall panel is connected to the second rectangular back wall panel along a common side;

(B) a second diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other along a common side;

(c) a diamond shaped bottom panel for closing the bottom of the carton; and (d) a diamond shaped top panel for closing the top of the carton; wherein the first rectangular front wall panel is connected to the first rectangular back wall panel along a common side, and the second rectangular front wall panel is connected to the second rectangular back wall panel via a reverse score glue panel along a common side; and (C) a third diamond shaped carton section having:

(a) first and second rectangular front wall panels having a top, a bottom, and two sides, the panels connected to each other along a common side;

(b) first and second rectangular back wall panels having a top, a bottom, and two sides, the panels connected to each other along a common side;

(c) a diamond shaped bottom panel for closing the bottom of the carton; and (d) a diamond shaped top panel for closing the top of the carton; wherein the first rectangular front wall panel is connected to the first rectangular back wall panel via a reverse score glue panel along a common side, and the second rectangular front wall panel is connected to the second rectangular back wall panel along a common side;

wherein the second rectangular front wall panel and second rectangular back wall panel in the second diamond shaped carton section are connected to the first rectangular front wall panel and first rectangular back wall panel in the first diamond shaped carton section via a reverse score glue panel along a common side, and the first rectangular front wall panel and first rectangular back wall panel in the third diamond shaped carton section are connected to the second rectangular front wall panel and second rectangular back wall panel in the first diamond shaped carton section via a reverse score glue panel along a common side, to form a one piece trio of diamond shaped cartons for packaging articles.

4. The one piece trio of diamond shaped cartons according to claim 3, wherein at least one rectangular wall panel contains a cut out for a window.

* * * * *